United States Patent [19]

Galiana

[11] Patent Number: 4,652,728

[45] Date of Patent: Mar. 24, 1987

[54] WIND AND COURSE CALCULATOR FOR NAVIGATION

[76] Inventor: Patrick Galiana, 15 avenue Honoré Baradat, 64000 Pau, France

[21] Appl. No.: 761,696

[22] Filed: Aug. 2, 1985

[30] Foreign Application Priority Data

Aug. 6, 1984 [FR] France ..... 84 12507

[51] Int. Cl.[4] ..... G06C 3/00

[52] U.S. Cl. ..... 235/88 N; 235/61 NV; 235/70 B; 235/78 N; 235/84

[58] Field of Search ..... 235/61 NV, 70 B, 78 N, 235/83, 84, 78 R, 88 N, 88 R

[56] References Cited

U.S. PATENT DOCUMENTS

| | | | |
|---|---|---|---|
| 3,231,188 | 1/1966 | Warner | 235/84 X |
| 3,361,346 | 1/1968 | Warner | 235/84 X |
| 3,497,681 | 2/1970 | Warner | 235/78 N |
| 3,625,417 | 12/1971 | Slauter | 235/61 GM X |
| 3,876,866 | 4/1975 | Kaspar | 235/88 R |

*Primary Examiner*—Benjamin R. Fuller

*Attorney, Agent, or Firm*—Oblon, Fisher, Spivak, McClelland & Maier

[57] ABSTRACT

A wind and course calculator for navigation is provided comprising two superimposed disks made from a transparent material, a mobile disk 1 movable in rotation and in translation carrying a network of concentric circles corresponding to the speeds and of converging straight lines corresponding to the angular values of headings and a supporting disk 2 having a mark 5 indicating the heading and, at its periphery, graduations corresponding to the angular values of sailing trims of the boat and a scale of speeds 7 carried on the radius directed towards the indication of the heading, on the reverse side of which supporting disk is fixed a pointer 10, 11 having a slider 12 carrying a reference dot 13 serving as display and reading point. The upper face of the supporting disk has two parallel guides 3 between which the mobile disk 1 slides.

This calculator is more particularly provided for use by competitors in sailing regatas for readily determining the surface wind, the heading to take, the basic course and the future surface wind related to the evolution of the current.

10 Claims, 16 Drawing Figures

FIG. 1B
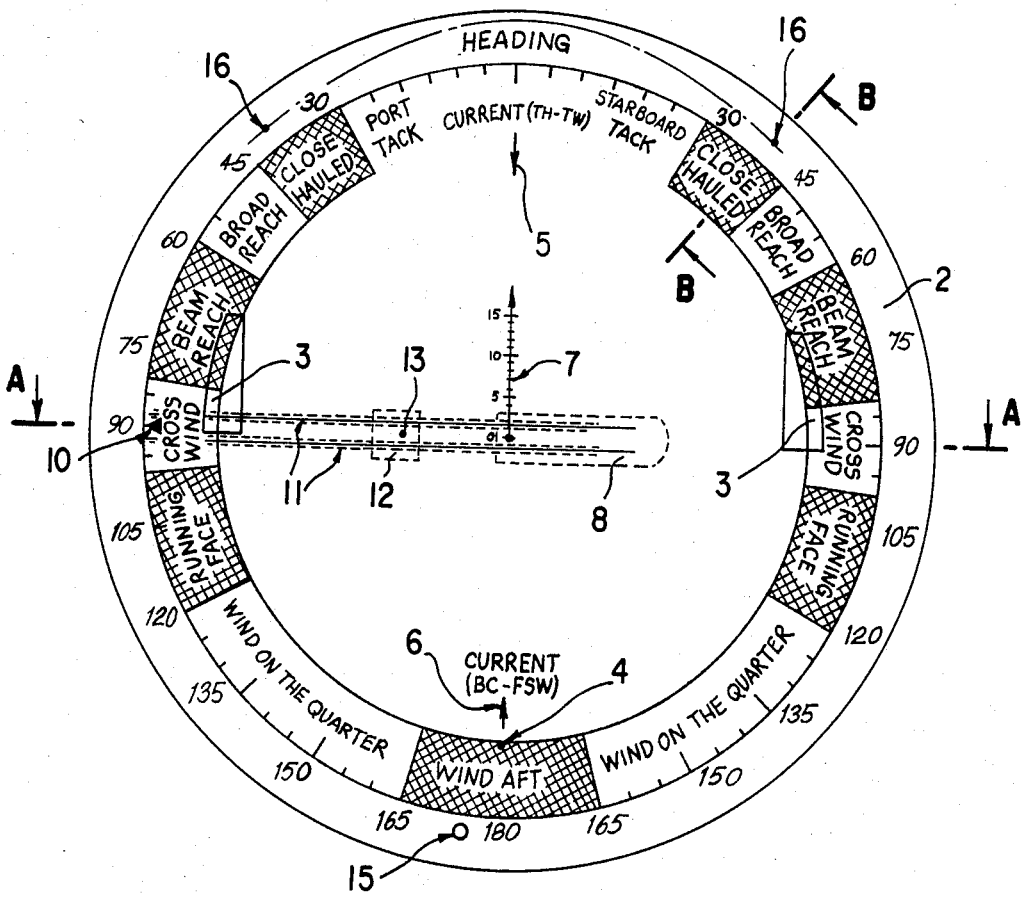
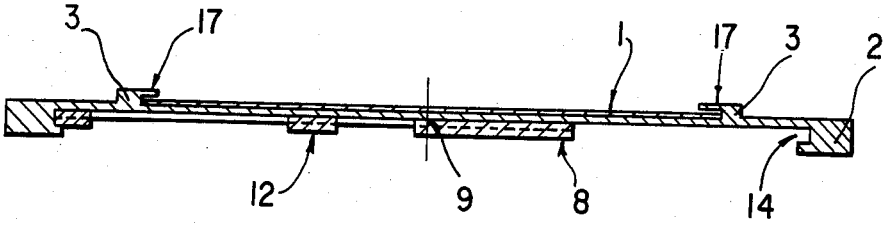
FIG. 2

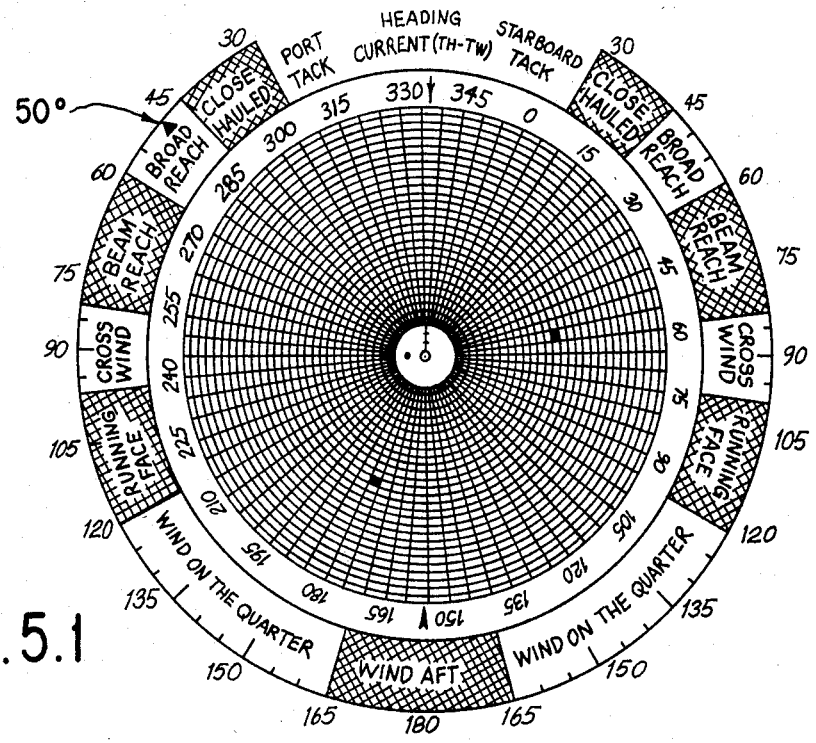
FIG. 5.1
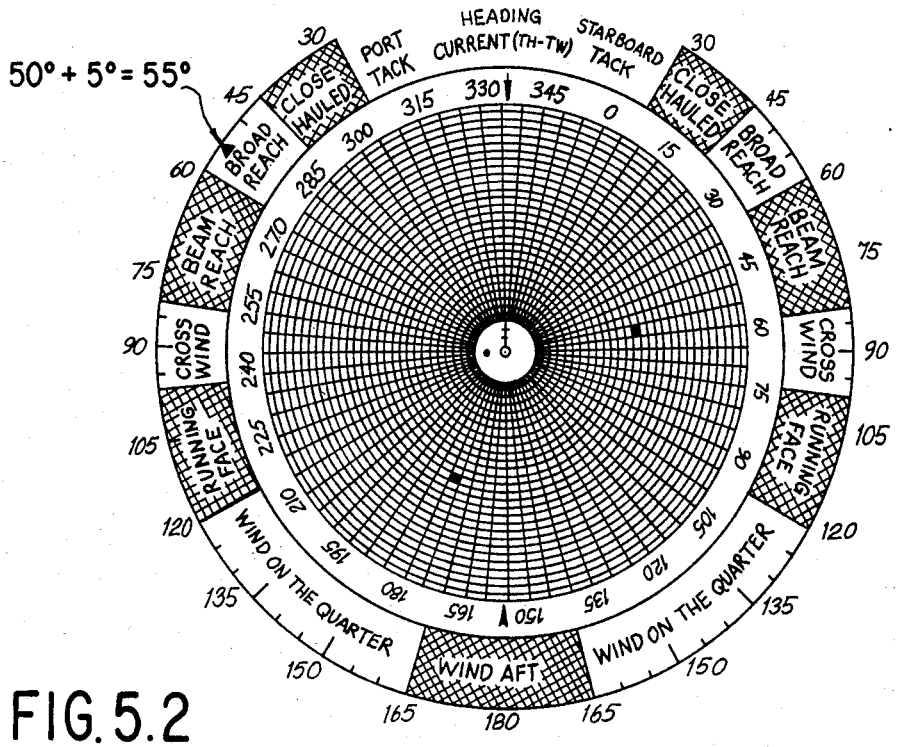
FIG. 5.2

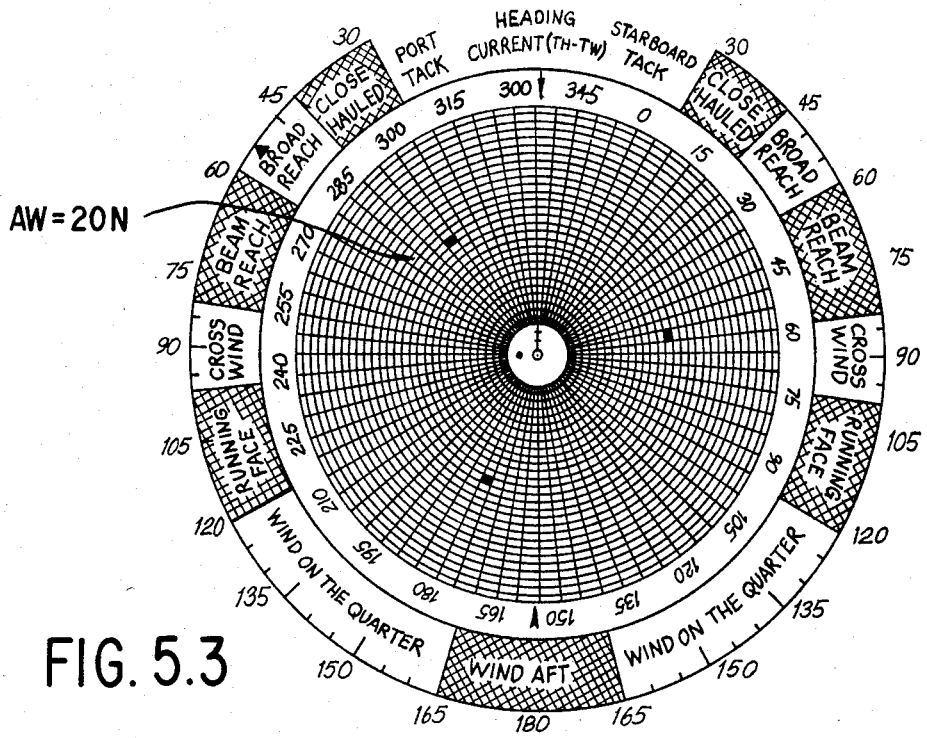
FIG. 5.3
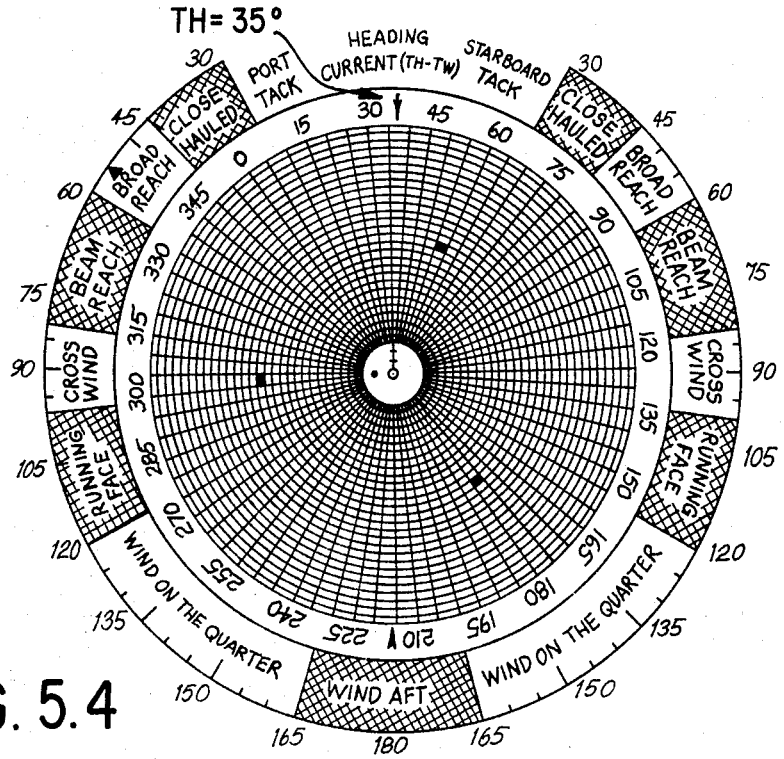
FIG. 5.4

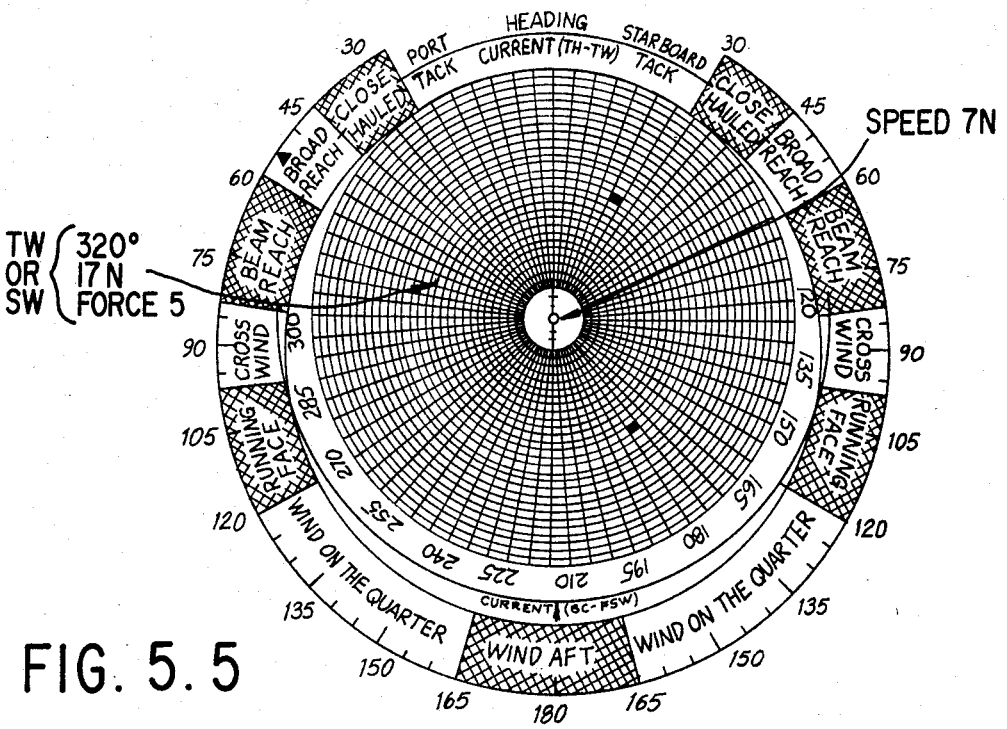
FIG. 5.5
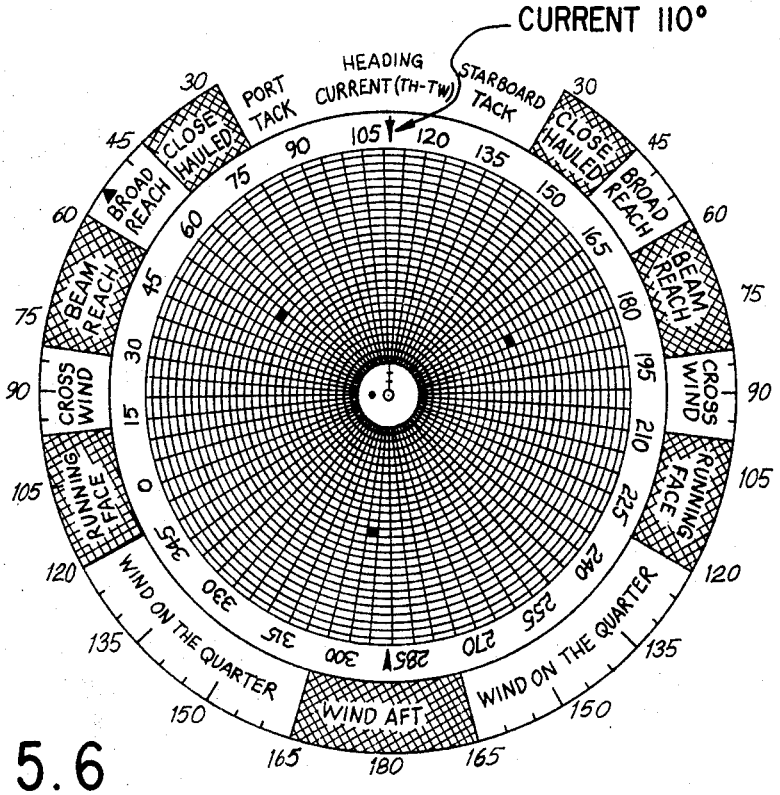
FIG. 5.6

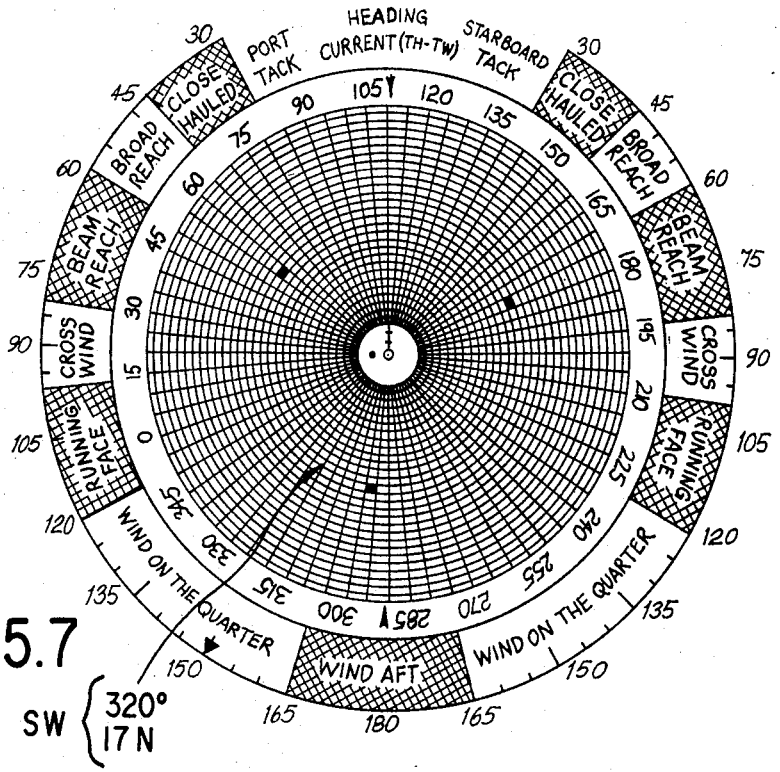
FIG. 5.7
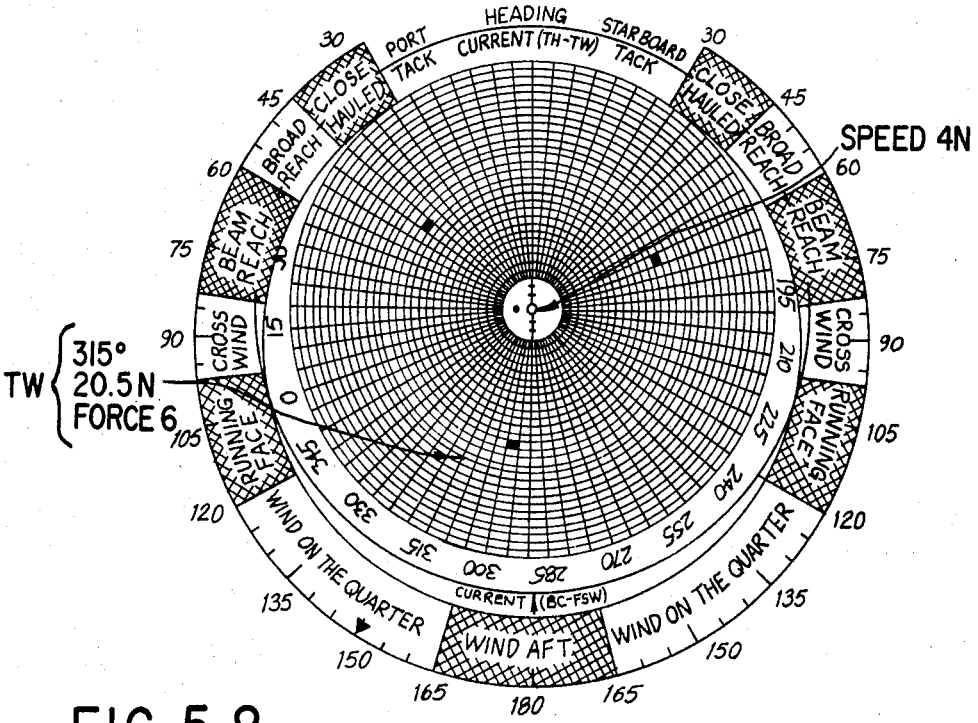
FIG. 5.8

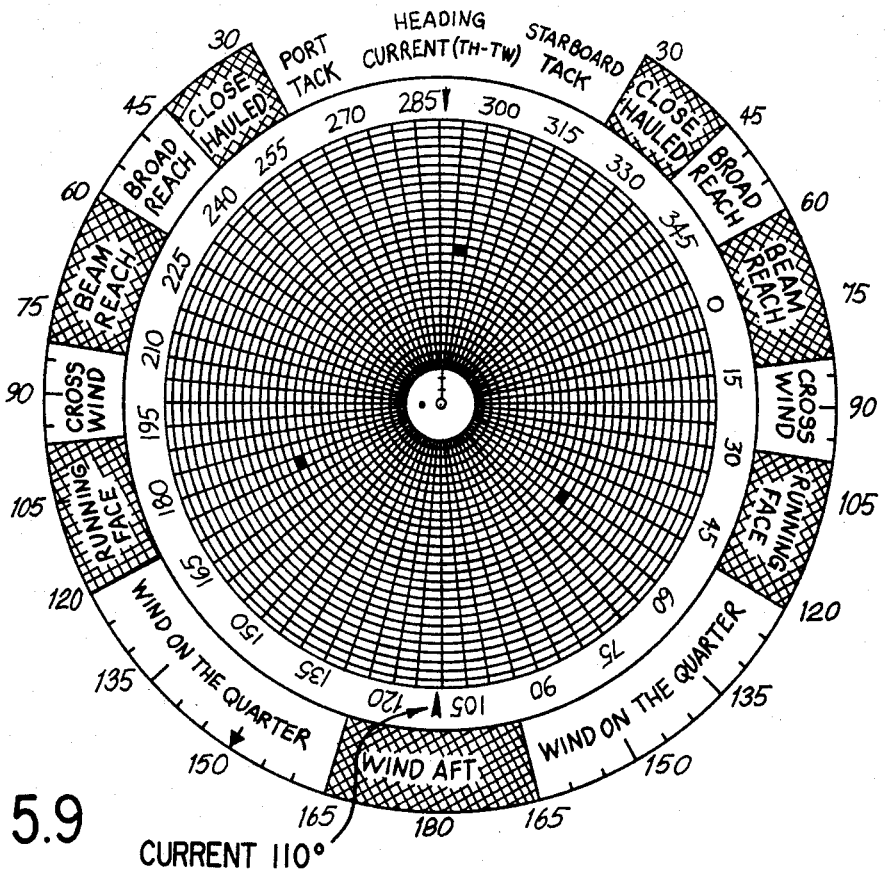
FIG. 5.9
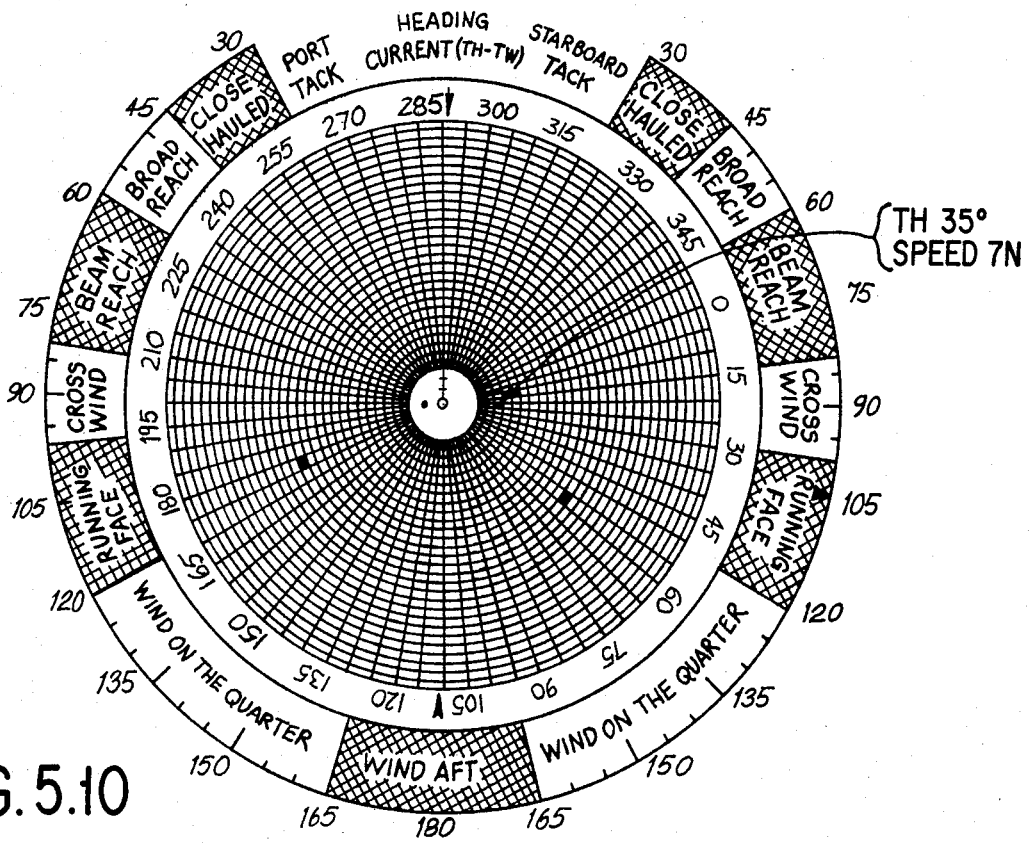
FIG. 5.10

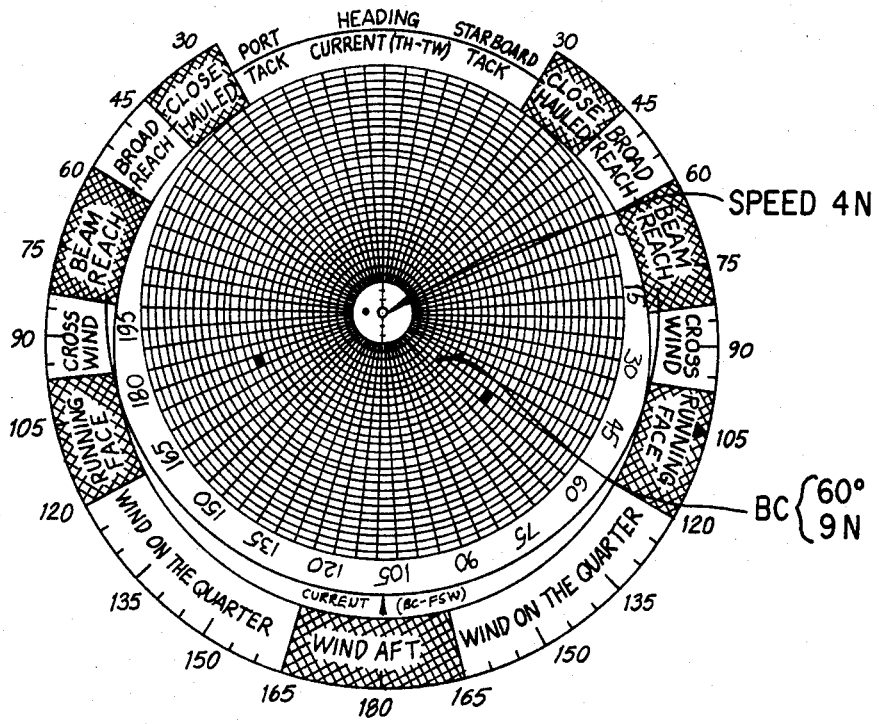
FIG. 5.11

WIND AND COURSE CALCULATOR FOR NAVIGATION

BACKGROUND OF THE INVENTION

1. Field of the Invention

The present invention relates to a wind and course calculator for navigational purposes so that a navigator aboard a boat underway, may very readily determine the true wind (direction, intensity, force), very readily without any plotting and without the risk of errors from the heading, the sailing trim, the drift, the speed of the boat and that of the apparent wind. In addition, in the most frequent case where a sea current is experienced, it also allows the surface wind, the heading to take for correcting the current drift, the basic course, as well as the future surface wind related to the evolution of the current to be determined.

The calculator of the invention is applicable to all ships, but mainly to sailing boats in general and to competetors in regattas in particular.

2. Discussion of the Background

Calculating the different parameters is usually achieved by means of graphic methods, requiring a map table, paper or map, a pencil, a protractor and a compass with risks of error in the case of a lack of attention or care.

There also exist wind calculators necessarily comprising several superimposed disks, some of which carry a graduated scale moving, when rotated, opposite fixed marks and others carrying marks moving opposite a fixed graduated scale, the set of disks being mobile in translation so as to come opposite a fixed mark, such as a graduated scale. Such calculators are of complicated construction because of the number of rotary parts required for the operation and present great difficulties in reading.

SUMMARY OF THE INVENTION

The present invention provides a calculator of very simple construction and, consequently, very easy to use for the navigator. It is characterized in that it comprises two superimposed disks made from a transparent material, a mobile disk carrying a network of concentric circles corresponding to the speeds and straight lines converging to the center of the disk corresponding to the angular values of headings from 0° to 360° and a supporting disk, whose diameter is greater than that of the mobile disk, which carries a mark indicating the heading or the direction of the current and, at its peripheral part projecting beyond the mobile disk, graduations corresponding to the angular sailing trim values of the boat, i.e. the direction of the longitudinal axis of the boat with respect to that of the wind, a scale of speeds, identical to that of the network of concentric circles of the mobile disk, being carried on the radius directed towards the heading indication and having as origin the center of the supporting disk, on the reverse side of which supporting disk there is fixed at its center a pointer rotating about its fixing point and having a slider which slides along the pointer and is provided with a guide mark serving as reading and display point, the upper face of the supporting disk having two guides parallel to the radius directed towards the heading indication and disposed symmetrically with respect to its center and whose spacing corresponds to the diameter of the mobile disk, between which guides said mobile disk is placed.

In fact, contrary to known constructions, the calculator of the invention only comprises a single rotatable and translatable disk associated with a rotary pointer carrying a slider, the slider providing through its reading point the display and reading of all the calculated parameters.

According to another feature of the invention, the center of the mobile disk forms a reference for positioning the mobile disk in translation over the scale of speeds carried by the supporting disk.

The peripheral part of the supporting disk is preferably graduated from 0° to 180° on each side of the heading indication, a special reference mark indicating the directin of the current being placed on the edge diametrically opposite the heading indication.

The pointer may be extended beyond its fixing point on the supporting disk by an operating arm.

Preferably, the peripheral end of the pointer carrying an arrow is guided by a circular groove integrated with the support disk and which holds it applied against said disk.

A stop fixed to the supporting disk determines a limit for travel of the mobile disk placing this latter concentrically with respect to the supporting disk.

In addition, one or more stops fixed to the supporting disk determine the other opposite end of travel limit of the mobile disk preventing it from escaping.

With each parallel guide of the mobile disk may be associated a flange forming with the wall of the guide a slide in which the mobile disk slides.

The scale of speeds with which the supporting disk is graduated in knots and corresponds to the speed of the boat or that of the current.

The scale of concentric circles of the network with which the mobile disk is provided is graduated in knots and corresponds to the speed of the winds, of the current and of the boat, said circles being grouped in zones defining the different ranges of the Beaufort scale.

BRIEF DESCRIPTION OF THE DRAWING

Other features of the invention will be clear from the following description of one embodiment given by way of example and illustrated by the drawings, in which FIG. 1B is a top view of the supporting disk, FIG. 2 is a sectional view through A—A of FIG. 1B, with the mobile disk placed on the supporting disk, FIGS. 5-1 to 5-11 show the respective positions of the two disks related to the example of FIG. 4.

DESCRIPTION OF THE PREFERRED EMBODIMENTS

Figure 1A:
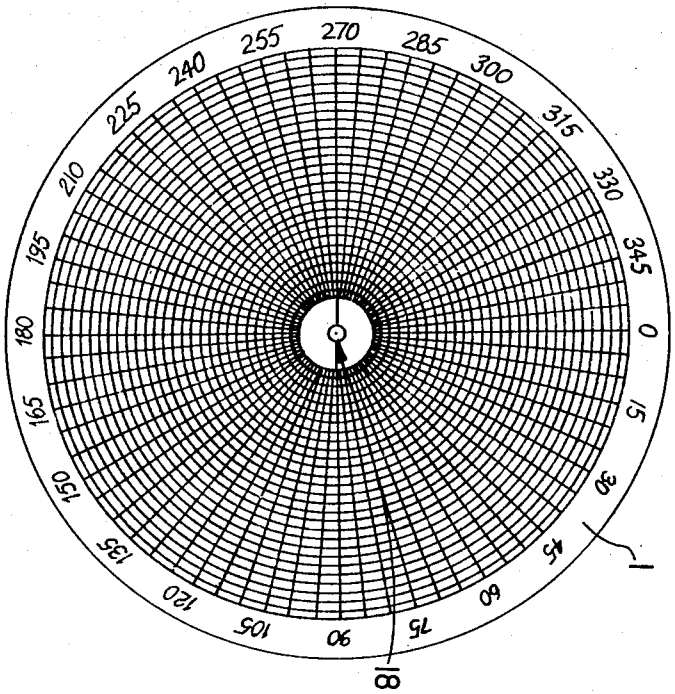
FIG. 1A is a top view of the mobile disk.

The mobile disk 1 and the supporting disk 2 are made from a transparent material, such as an acrylate based plastic material.

The mobile disk 1 of a diameter of about 14 cm carries a network of graduations from 0° to 360° materialized by straight lines converging at its center and corresponding to the values of headings and of the concentric circles showing the speeds in knots. Since the speeds corresponding to the concentric circles relate not only to the speeds of the current and of the boat but also to that of the wind, said concentric circles have in addition alternate colored zones which define the different ranges of the Beaufort scale shown on the network by the references 1 to 7.

The network is advantageously etched or printed on the transparent plastic material. The center 18 of disk 1 forms a reference for placing it, by moving the disk in translation, against a fixed scale of the supporting disk.

The supporting disk 2 of a diameter of about 18 cm is also made from a transparent material and comprises indications. It is divided into two equal parts; starboard tack and port tack, on each side of its axis. Each of these parts is in addition divided into sectors corresponding to the different sailing trims used in seamanship. At the top of the disk can be seen the indication HEADING and CURRENT having an arrow 5 situated on its axis, then on each side, the indication of the sailing trims as well as corresponding angular values from 0° to 180° graduated every 5°.

Diametrically opposite the indication HEADING and CURRENT we find the indication CURRENT, having an arrow 6. In the center of the disk is provided a scale of speeds 7 graduated in knots, identical to the scale of the mobile disk and orientated along the radius directed towards the indication HEADING, arrow 5, the zero being in the center of the disk.

Under the disk at its center there is fixed by means of a rivet 9 a pointer extended by an operating arm 8 and which comprises at its end an arrow 10 surrounded by three 1° graduations on each side for indicating the different sailing trims and for perfecting the display thereof, by means of two steel rods 11 over which slides a slider 12, whose small transparent material plate carries a mark in the form of a dot 13 which serves for displaying values and obtaining the different results by simple reading from the network of the mobile disk.

On the lower face of the disk there is formed a circular groove 14 integrated with the disk, in which arrow 10 is guided and which holds it applied against the lower face of the disk.

The upper face of disk 2 carries two guides 3 parallel to the scale of speeds 7 and disposed symmetrically with respect to its center. The spacing between guides 3 corresponds to the diameter of the mobile disk 1, so that the mobile disk may be guided in translation.

Stop 4 is fixed to the top of the supporting disk 2 and it is placed so that the mobile disk, when it abuts by its lower edge against this stop, has its center 18 merged with the center of the supporting disk.

Each guide 3 is associated with a flange 17 which forms with the face of the guide a slide in which the mobile disk can slide without being able to deviate from the supporting disk.

On the upper face of the supporting disk are fixed two stops 16 which prevent the mobile disk from breaking free upwardly.

In the description of the different uses of the calculator, the notions known by navigators will be used, which are recalled hereafter.

The direction of the wind is that from whence it comes, the direction of the current is that in which it flows.

The apparent wind (AW) is the wind which is received on board the moving boat.

The surface wind (SW) is the wind received by an object freely floating on the surface of the water, so experiencing the effect of the current.

The true wind (TW) is the wind received by a point fixed with respect to the seabed.

The future surface wind (FSW) is the surface wind related to the evolution of the current.

The apparent heading (AH) is the direction of the longitudinal axis of the boat.

The true heading (TH) is the apparent heading corrected for wind drift.

The surface course (SC) is the vector having for direction the true heading and for intensity the speed of the boat.

The basic course (BC) is the vector corresponding to the course of the boat on the map.

The basic heading (BH) is the direction of the basic course.

In the case where there is no current or if it is negligible, only the speed and direction parameters of the true wind (TW) or of the future surface wind (FSW) will be calculated since the other parameters do not exist. In the case where there is a current, the following will be calculated by choice: the true heading (TH); the basic course (BC); the surface wind (SW); the surface wind (SW) and the true wind (TW); the surface wind (SW), the true wind (TW) and the future surface wind (FSW).

Figure 4:
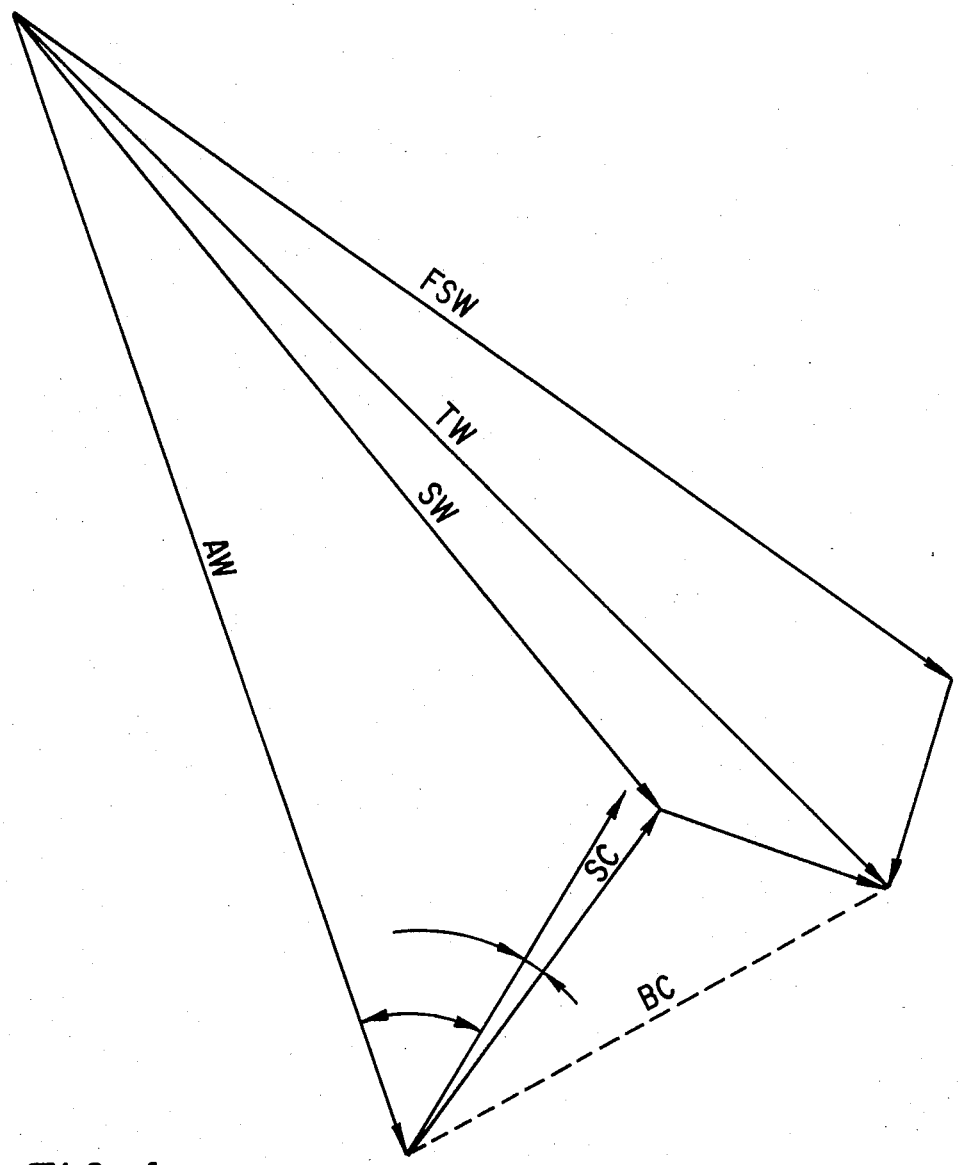
FIG. 4 shows a graphic example of the vectors used in a calculation.

FIG. 4 shows graphically all the vectors which are used in calculations which may be made by means of the calculator of the invention.

The data supplied by the boat's instruments are the speed of the apparent wind, its direction with respect to the axis of the boat (trim), the drift, the speed and the direction of the boat, whereas the characteristics of the current are available from the map depending on the times of tides. With these data, the vectors shown in FIG. 4 may be calculated in order, namely for the winds, SW, TW, FSW, and for the course, TH and BC.

The AW is the vectorial sum of SW and of the relative wind created by SC.

The SW is the vectorial sum of TW and of the relative wind created by the current.

The FSW is the vectorial sum of TW and of the relative wind created by the future current.

The BC is the vectorial sum of SC and of the current.

Before each operation, the mobile disk is placed concentrically on the supporting disk by means of stop 4.

For calculating the direction and speed of the surface wind, the procedure is as follows.

End 10 of the pointer is placed on the Figure of the scale of trims corresponding to the direction of the apparent wind with respect to the apparent heading (FIG. 5-1, 50° port tack trim). To this value is added the value of the drift (FIG. 5-2, 5°).

Figure 3:
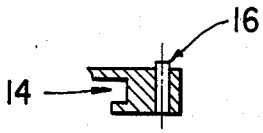
FIG. 3 is a sectional view through B—B of FIG. 1B.

Slider 12 is slid along the pointer so that the reading dot 13 is placed on the concentric circle corresponding to the speed of the apparent wind (FIG. 5-3, 20 knots). The mobile disk 1 is rotated so as to place the angular value of the true heading (FIG. 5-4, 35°) opposite mark 5 of the heading. Then the mobile disk guided by guides 3 is slid so that the center of the mobile disk is placed on the numerical value of scale 7 indicating the speed of the boat (FIG. 5-5, 7 knots). The position of dot 13 with respect to the converging straight lines of the mobile disk gives the direction of the surface wind and its position with respect to the concentric circles of the mobile disk gives the speed of this wind.

In the case shown in FIGS. 5-1 to 5-5, the sailing trim is 50° on the port tack, the drift is 5°, the speed of the apparent wind 20 knots, the true heading 35°, the speed of the boat 7 knots. The calculated wind is orientated at 320° with respect to the geographical North and its speed is 17 knots.

When the current is negligible, the same operation as practised about gives the true wind.

For calculating the true wind for a current which is not negligible, the mobile disk is rotated first of all so as to place the angular value corresponding to the direction of the current (FIG. 5-6, 110°) opposite mark 5 of the heading. Then the pointer is rotated so as to place dot 13 on the figure of the scale with which the mobile disk is provided and corresponding to the direction of the surface wind (320°) and slider 12 is slid so as to place the reading point 13 on the concentric circle of the mobile disk corresponding to the speed of this wind (FIG. 5-7, 320° and 17 knots). The mobile disk is slid while maintaining its angular orientation (110°) so as to place its center on the numerical value of scale 7 indicating the speed of the current (FIG. 5-8, 4 knots). Since the mobile disk has moved with respect to the reading dot 13, the direction of the true wind is read off by observing that the reading dot 13 is placed on the converging straight line of the mobile disk corresponding to the angle of 315°, the speed of the true wind is read off by observing that this point is placed on the concentric circle of the mobile disk corresponding to 20.5 knots, in addition the different colored zones indicate that it is a wind of force 6 on the Beaufort scale (FIG. 5-8, 315°, 20.5 knots, force 6).

For calculating the future surface wind (FSW), the direction of the future current is first of all indicated by rotating the mobile disk with respect to the mark 6 at the bottom of the supporting disk, the mobile disk is held in position while the direction and speed of the true wind (TW) is indicated with dot 13, finally the speed of the future current is indicated with the center 18 of the mobile disk while maintaining its orientation. Dot 13 gives the direction, the speed and the force of the FSW on the mobile disk.

During course calculations involving the presence of a current, the procedure is as follows.

For calculating the true heading (TH), the direction of the current is indicated opposite mark 5 by rotating the mobile disk, the mobile disk is held in position and the basic heading (BH) which is the desired course is indicated with dot 13. For a clearer display the dot is brought onto the last circle.

The speed of the current is indicated by means of the center 18 of the mobile disk by moving this latter while maintaining its orientation.

Reading from the mobile disk by means of dot 13 gives the TH, when the estimated speed of the boat is displayed by sliding the slider over the pointer.

For calculating the basic course (BC), the mobile disk is rotated so as to place the angular value corresponding to the direction of the current (FIG. 5-9, 110°) opposite mark 6 (current) of the supporting disk. The pointer is rotated so as to place dot 13 on the figure of the scale of the converging straight lines of the mobile disk corresponding to the direction of the true heading and slider 12 is moved so as to place the reading dot 13 on the concentric circle of the mobile disk corresponding to the speed of the boat (FIGS. 5-10, 35° and 7 knots). The mobile disk is slid so that its center 18 is placed on the numerical value of scale 7 corresponding to the speed of the current (FIG. 5-11, 4 knots). The position of the reading point 13 with respect to the converging straight lines of the mobile disk gives the direction of the basic course (60°) and its position with respect to the concentric circles gives its speed (9 knots).

The following table sums up the above described operations in the order in which they are carried out. Calculation of the current (similar to the others) has been added but the operation is not given in detail.

| | WITHOUT CURRENT | WITH CURRENT | "POINTER" | "DISK" | "DOT" | "DISK" |
|---|---|---|---|---|---|---|
| WIND | TW | SW | TRIM + DRIFT | → | AW | SC |
| | | TW | → | CURRENT | SW | CURRENT |
| | FSW | FSW | → | (DIRECTION) | TW | (SPEED) |
| COURSE | | TH | → | | BH | |
| | | BC | → | | SC | |
| | CURRENT | | → | SC(DIRECTION) | BC | SC(SPEED) |

For all the calculations other than that of TW (without current) or of SW (with current) the first operation consists in rotating the mobile disk so as to indicate the direction of the current. The second operation consists in indicating using dot 13 on the mobile disk the direction of the wind, of the course or heading and, by sliding slider 12 along the pointer, in placing dot 13 on the value of the speed of the wind or that of the boat. Thus, the second operation uses the parameter resulting from the preceding operation, namely that concerning the SW, TW, BH or SC.

The third operation again concerns the current and consists in sliding the mobile disk so as to display the speed of the current by means of its center 18 on scale 7.

For calculating the true wind (TW) without current or the surface wind (SW) with current, the first operation consists in indicating the sailing trim to which the drift has been added by means of arrow 10 on the scale of the supporting disk. The other two operations concern mving the slider so as to indicate the speed of the apparent wind (AW) and rotating the disk depending on the angular value of the true heading, plus the translational movement of the disk for indicating the speed of the boat.

The rapid determination of the above parameters allows the navigator:

in the case of tacking, to know the heading on the other tack and so the moment when to go about to rapidly know the heading to take so as to compensate for the drift for any current variation, particularly useful for rescue boats.

to know the next surface wind as a function of the current variations, so as to be able to modify his course and so as to be in the best position before the shift of the surface wind, to estimate the sailing trim and the force of the apparent wind which will be experienced for a given heading and wind, so as to be able to prepare the sails accordingly, to determine the best "close hauled trim" or the best "off wind sailing trim", to resolve numerous problems met with by competitors in regattas, such as tacking, the first tack to be made, safety cone and others.

The calculator of the invention allows all these parameters to be readily calculated using a single disk movable in rotation and in translation and the pointer associated with the supporting disk and having its slider. The invention is not limited to the embodiment given by way of example, but is susceptible of numerous variants which may be made by a man skilled in the art, in particular by modifying the scales of values used.

What is claimed is:

1. A wind and course calculator for solving boat navigational problems, such as determining the speed and the direction of the true wind and, in case of sea current, determining the surface wind, the heading for correcting the current drift, the basic course and the future wind related to the evolution of the current, by temporarily recording or displaying data supplied by the boat instruments, such as the speed of the apparent wind, its direction with respect to the axis of the boat (trim), the drift, the speed and the direction of the boat and, for the sea current, data available from a map depending on the times of tides, comprising:

a supporting disk (2) having upper and lower faces and a diameter said supporting disk being made of a transparent material;

a mobile disk (1) made of a transparent material, having a diameter that is smaller than said diameter of said supporting disk, and being rotatably and slidably mounted on said upper face of said supporting disk;

a pointer (10, 11) rotatably mounted at the center (9) of said supporting disk on said lower face thereof; and a slider (12) slidably mounted on said pointer and having a reference dot (13) serving as a display and reading point, said mobile disk carrying indica including a network of concentric circles and straight lines converging toward the center of said mobile disk, said concentric circles forming a scale adapted graphically to represent speed values of the current, of the boat and of the wind, said converging lines representing heading values from zero degrees to three hundred sixty degrees, said supporting disk carrying indica including a heading mark (5) on the periphery thereof for indicating the heading or the direction of the current and a plurality of labeled regions on the periphery of said supporting disk, said labeled regions being disposed on each side of said heading mark and respectively corresponding to starboard tack and port tack, said labeled regions corresponding to angular values of sailing trims of the boat, said indica of said supporting disk further comprising a linear scale of speeds (7) identical to said concentric circles of said mobile disk, said linear scale being directed toward said heading mark (5) on said supporting disk and having as its origin the center of said supporting disk, said supporting disk further comprising two guides (3) disposed on said upper face thereof parallel to said linear scale of speeds and being disposed symmetrically with respect to said center of said supporting disk at a distance apart substantially equal to said diameter of said mobile disk, said mobile disk being slidably disposed between said guides.

2. Calculator according to claim 1, further comprising an opposite mark (6) on the periphery of said supporting disk diametrically opposite said heading mark (5) for indicating the direction of the current, the periphery of said supporting disk having two sets of graduations, one for each of said port and starboard tacks, extending in opposite directions from said heading mark and graduated from zero degrees to one hundred eighty degrees.

3. Calculator according to claim 1, characterized in that the center (18) of the mobile disk (1) forms a reference for positioning the mobile disk in translation on the scale of speeds (7) carried by the supporting disk (2).

4. Calculator according to claim 1, characterized in that the pointer (10, 11) is extended beyond its fixing point on the supporting disk (2) by an operating arm (8).

5. Calculator according to claim 1, characterized in that the peripheral end (10) of the pointer is provided with an arrow guided by a circular groove (14) integral with the supporting disk (2) and which holds it applied against said disk.

6. Calculator according to claim 1, characterized in that a stop (4) fixed to the supporting disk (2) defines a limit of travel of the mobile disk (1) placing this latter concentrically with respect to the supporting disk (2).

7. Calculator according to claim 1, characterized in that one or more stops (16) fixed to the supporting disk (2) define an opposite limit of travel of the mobile disk (1) preventing this latter from escaping.

8. Calculator according to claim 1, characterized in that with each parallel guide (3) is associated a flange (17) forming with the guide a slide in which the mobile disk (1) slides.

9. Calculator according to one of claims 3, 4–8, 1 or 2, characterized in that the scale of speeds (7) with which the supporting disk (2) is provided is graduated in knots and corresponds to the speed of the boat or to that of the current.

10. Calculator according to one of claims 3, 4–8, 1 or 2, characterized in that the scale of concentric circles of the network with which the mobile disk (1) is provided is graduated in knots and corresponds to the speed of the winds, of the current and of the boat, said circles being grouped in zones defining the different ranges of the Beaufort scale.

* * * * *